US006173451B1

(12) United States Patent
DeVincenzi

(10) Patent No.: US 6,173,451 B1
(45) Date of Patent: Jan. 16, 2001

(54) GOLFER'S ACCESSORY WRIST BAND

(76) Inventor: Dominic DeVincenzi, 4300 Broadway, Walnut Creek, CA (US) 94611

( * ) Notice: Under 35 U.S.C. 154(b), the term of this patent shall be extended for 0 days.

(21) Appl. No.: 09/553,740

(22) Filed: Apr. 20, 2000

(51) Int. Cl.[7] ..... A41D 19/00
(52) U.S. Cl. ..... 2/162; 2/161.2; 446/406
(58) Field of Search ..... 2/162, 161.2, 160, 2/161.1; 446/406, 285

(56) References Cited

U.S. PATENT DOCUMENTS

| | | | | |
|---|---|---|---|---|
| 2,187,987 | | 1/1940 | Sherrick | 2/160 |
| 3,629,867 | | 12/1971 | Taylor | 2/160 |
| 3,847,110 | | 11/1974 | Inoue | 116/120 |
| 3,895,797 | | 7/1975 | Moore | 273/32 A |
| 4,069,954 | | 1/1978 | Rauch | 224/5 C |
| 4,489,444 | | 12/1984 | Graham | 2/160 |
| 4,736,877 | * | 4/1988 | Clark | 224/252 |
| 5,365,609 | | 11/1994 | Herzog | 2/161.4 |
| 5,419,551 | * | 5/1995 | Hoyt et al. | 273/32 B |
| 5,730,658 | | 3/1998 | Kurtz et al. | 473/205 |
| 5,779,558 | * | 7/1998 | Britton | 473/286 |
| 5,853,336 | * | 12/1998 | Hufgard | 473/282 |

* cited by examiner

*Primary Examiner*—Bibhu Mohanty
(74) *Attorney, Agent, or Firm*—Elliot B. Aronson

(57) ABSTRACT

An improved wrist band for carrying golf tees, ball position markers and other small accessories such as a divot tool. The wrist band includes a carrier band having a fastener for securing the carrier band around the user's wrist, a golf tee holder attached to the carrier band defining a plurality of tee pockets for receiving a plurality of golf tees, and a retaining member attached to the carrier band for receiving and holding a plurality a golf ball markers. The golf ball markers themselves have a shaft end that is used for retaining the marker in position on the ground, and the retaining member is formed to frictionally hold the golf ball markers by their shaft ends. In one embodiment the retaining member is formed to define an array of openings or holes that are sized to receive and frictionally retain the ball marker shaft ends. In this way a ball marker is simply pushed into the retaining member being worn on the user's wrist and may be easily and quickly pulled off of the retaining member when needed during play.

6 Claims, 4 Drawing Sheets

GOLFER'S ACCESSORY WRIST BAND

BACKGROUND OF THE INVENTION

The present invention relates generally to carriers for golf accessories such as tees and ball position markers and is more particularly directed to a wrist band to be worn by a golfer during play for carrying such accessories.

Golfers must carry a supply of small accessories such as golf tees, ball position markers, divot tools, and the like. In the past it has proved inconvenient to carry these items in a pocket or in a compartment on the golf bag that holds the clubs. A number of devices are known for carrying such small accessories that take the form of articles of clothing with attachments carrying the desired items. For example, U.S. Pat. No. 2,187,987 of Sherrick shows a basic golf glove of the type worn by golfers during play to grip the club better, which includes a small pocket on the back side for carrying small accessories. U.S. Pat. No. 3,629,867 of Taylor shows a general purpose glove not specifically intended for golfers, to which is attached a holder for pencils, pens or other writing instruments such as may be useful to carpenters or other workmen. U.S. Pat. No. 3,847,110 of Inoue shows a golfer's glove to which a score indicator is secured by a hook and loop fastener so that the score may readily be changed after each hole and held in secure position on the glove during play. U.S. Pat. No. 5,365,609 to Herzog shows a golf glove, to which a retainer is secured by a hook and loop fastener for holding several golf tees and a ball position marker. U.S. Pat. No. 5,730,658 of Kurtz et al. shows another golf glove to which a golf scoring device is secured on the back side by a hook and loop fastener.

A number of prior art patents have focused on ball position markers. U.S. Pat. No. 3,895,797 of Moore shows a ball position marker that has a loop material fastened to the base so that the marker may be attached to a cooperating hook material that is mounted on an article of clothing such as the visor of a cap. U.S. Pat. No. 4,489,444 of Graham shows a wrist strap joined with a hook and loop fastener for holding ball position markers. The base of the marker lies between the hook and loop fastener flaps and the shaft extends through an aperture in one of the flaps so that the marker is held securely between the flaps. U.S. Pat. No. 4,069,954 of Rauch shows a golfer's wrist band that is arranged to carry golf tees and ball markers. Rauch employs a slit that acts generally like a button hole for receiving a ball marker. The head of the ball marker is inserted in the button hole so that the shaft of the ball marker extends outward through the button hole. All of these known devices for carrying golf accessories present deficiencies and inconveniences when in use.

SUMMARY OF THE INVENTION

The present invention provides an improved wrist band for carrying golf tees, ball position markers and other small accessories such as a divot tool or scoring device. The wrist band provides the user with improved access to the various accessories being carried on the wrist band and also provides a mechanism for carrying ball markers that makes it particularly easy to attach and remove a ball marker from the wrist band.

Briefly, a golfer's accessory wrist band according to the invention includes a carrier band having a fastener for securing the carrier band around the user's wrist, a golf tee holder attached to the carrier band defining a plurality of tee pockets for receiving a plurality of golf tees, and a retaining member attached to the carrier band for receiving and holding a plurality a golf ball markers. The golf ball markers themselves have a shaft end that is used for retaining the marker in position on the ground, and the retaining member is formed to frictionally hold the golf ball markers by their shaft ends. In one embodiment for example the retaining member may be formed to define an array of openings or holes that are sized to receive and frictionally retain the ball marker shaft ends. In this way a ball marker is simply pushed into the retaining member being worn on the user's wrist and may be easily and quickly pulled off of the retaining member when needed during play.

Other aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
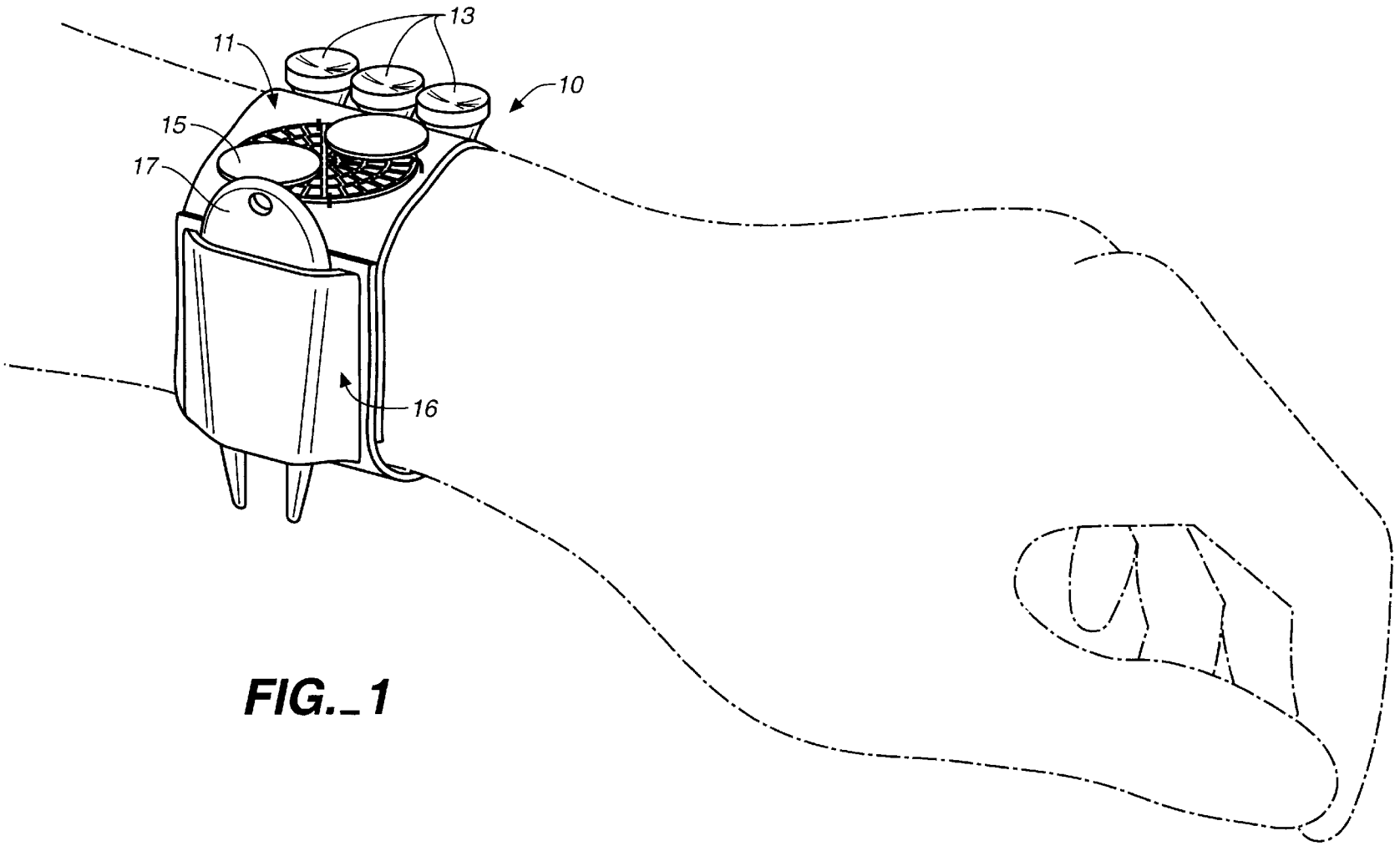
FIG. 1 is an overall perspective view showing an embodiment of a golfer's wrist band according to the invention being worn on a golfer's arm.
Figure 2:
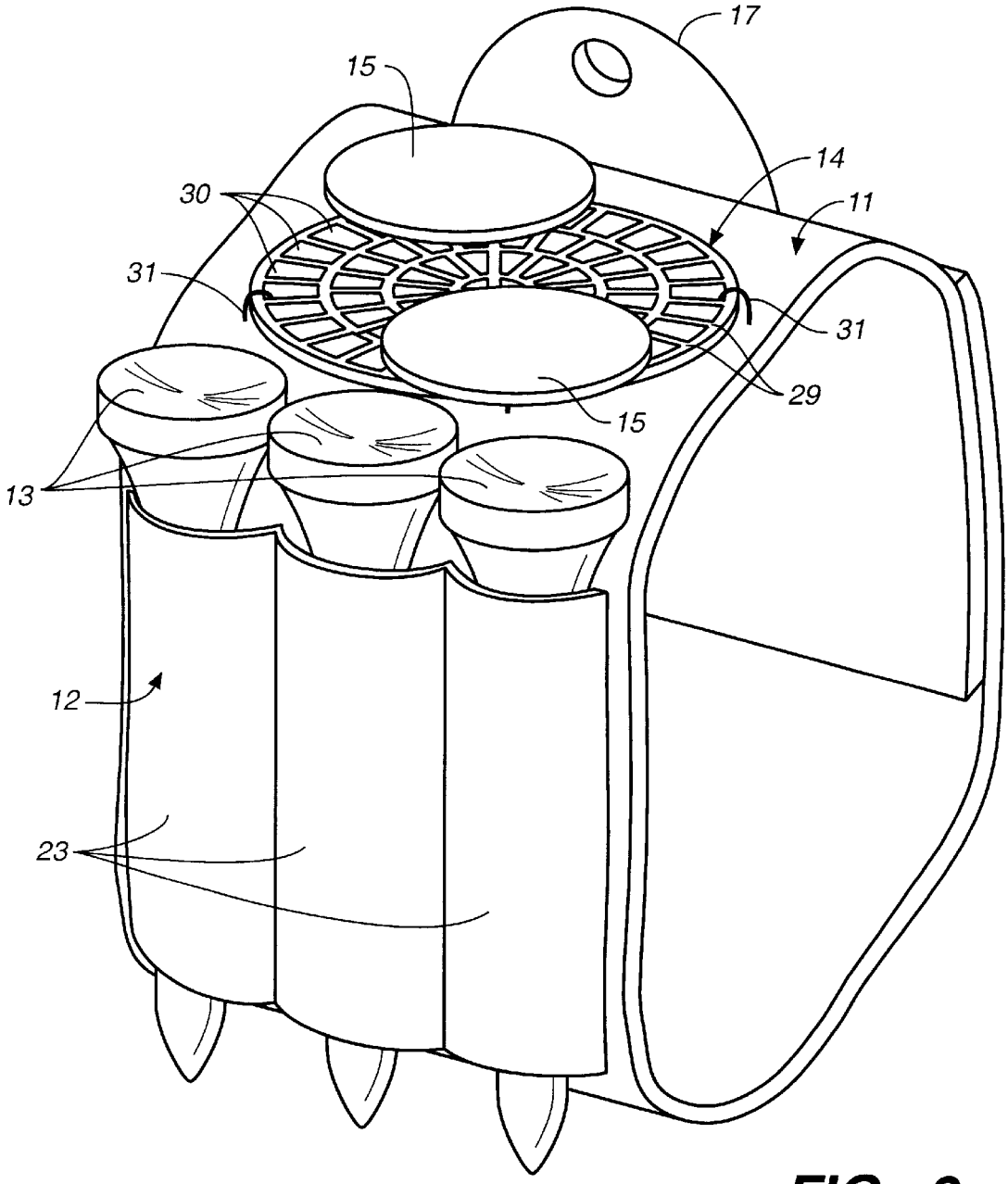
FIG. 2 is a perspective view of the embodiment of FIG. 1 in closed configuration removed from the wearer's arm.
Figure 3:
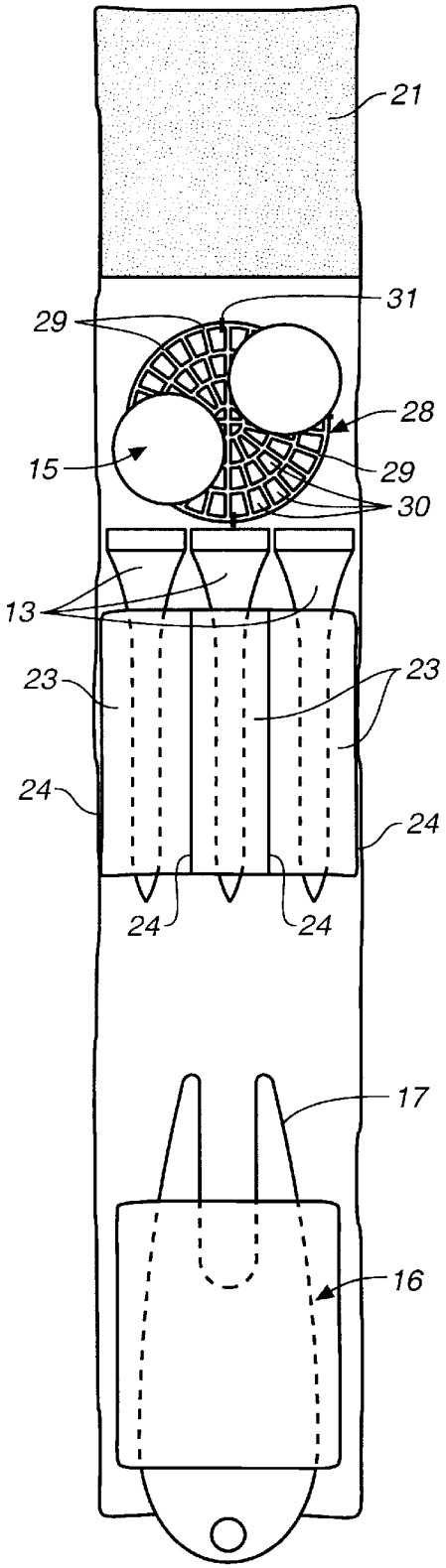
FIG. 3 is a plan view of the embodiment of FIG. 2 with the wrist band in a flat configuration and holding several golf accessories.

For purposes of illustration a specific embodiment of the invention will now be described with reference to the Figures. FIG. 1 shows a golfer's wrist band indicated generally at 10 positioned on the arm of a user shown in phantom. The wrist band includes a carrier band 11 on which are disposed a golf tee holder 12 for holding a plurality of golf tees 13, a ball marker holder 14 for holding a plurality of golf ball position markers 15, referred to simply as "ball markers," and an auxiliary holder 16 for holding another golf accessory such as a divot tool 17.

Carrier band 11 fits around the wearer's wrist and includes a fastener for securing the band to the wrist. In the illustrated embodiment the fastener is provided by a hook and loop fastener of the type commonly available under the trademark Velcro.® A first hook and loop strip 21 is attached to one end of carrier band 11 and a cooperating hook and loop strip 22 of the opposite character to the first strip 21 is attached to the underside of carrier band 11 at the opposite end. Such hook and loop fasteners are particularly convenient for adjusting the size of the carrier band to fit the individual wearer; however, other types of fasteners may also be used, for example, a buckle of the type commonly used on watch bands.

To assist in securing the carrier band snugly to the wearer's wrist, the band is preferably formed of a material that is stretchable at least in the longitudinal direction so that the band may be pulled snugly around the user's wrist. A wide variety of stretchable materials and configurations are available for this purpose, and those skilled in the art will readily be able to select a suitable material and design to meet the needs of wearability, durability, cost requirements and stylistic design. Carrier band 11 may be formed of a single piece of stretchable material or may include one or more sections of stretchable material alternating with non-stretchable sections. Although the use of a stretchable material is generally preferred, the carrier band may also be made of other materials such as leather or plastic.

Golf tee holder 12 provides a plurality of elongate loops or pockets 23 for holding individual tees 13. The tee holder may be provided by a stretchable material sewn or otherwise secured to the carrier band along longitudinal rib lines 24 to define the tee pockets 23. The material is stretchable in the direction across the carrier band, that is to say, transverse to the elongate direction of the pockets, so as to hold the tees snugly in the pockets.

Figure 4:
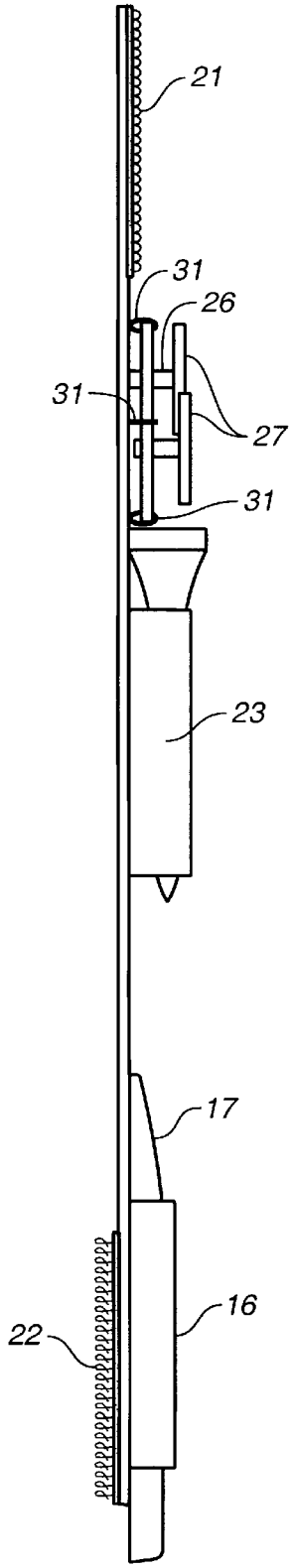
FIG. 4 is a side view of the configuration of FIG. 3.
Figure 5:
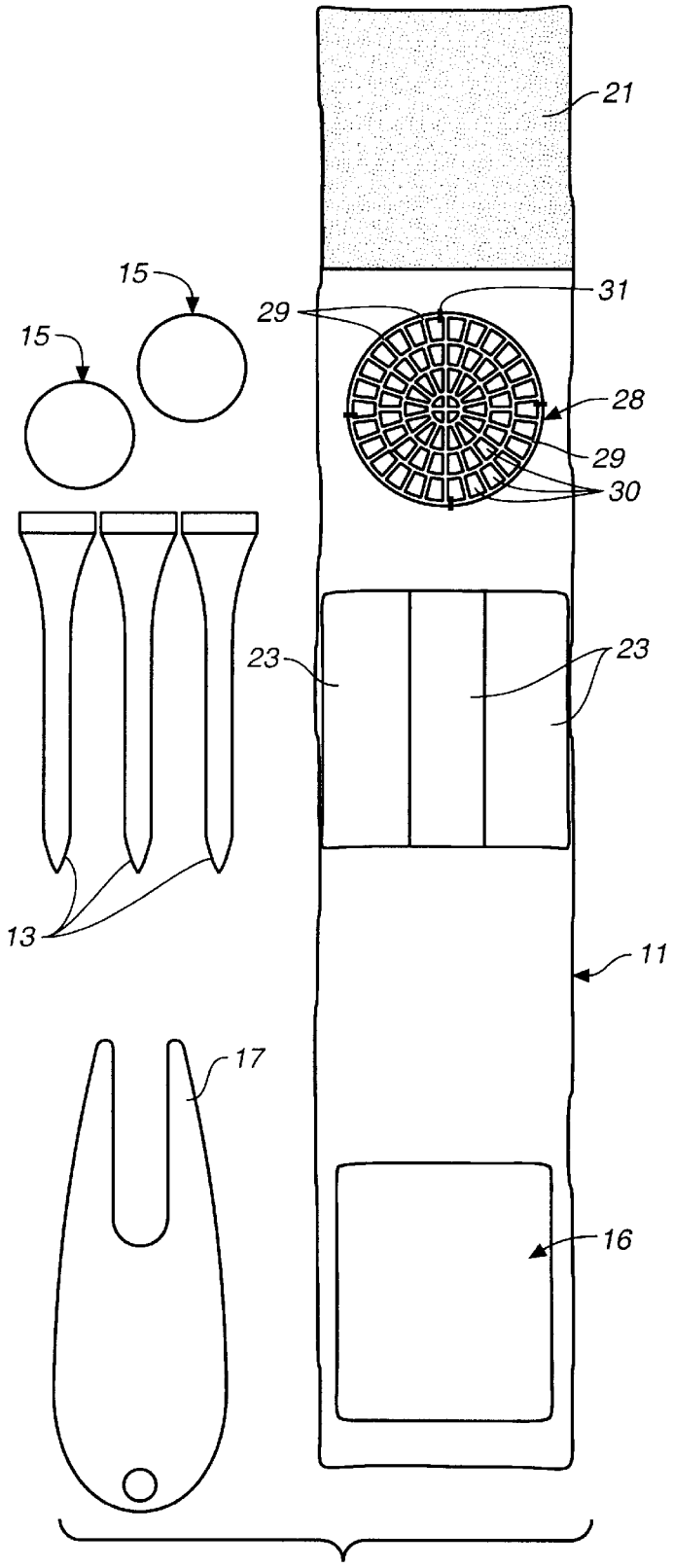
FIG. 5 is a plan view of the embodiment of FIG. 3 showing the accessories removed from the wrist band.
Figure 6:
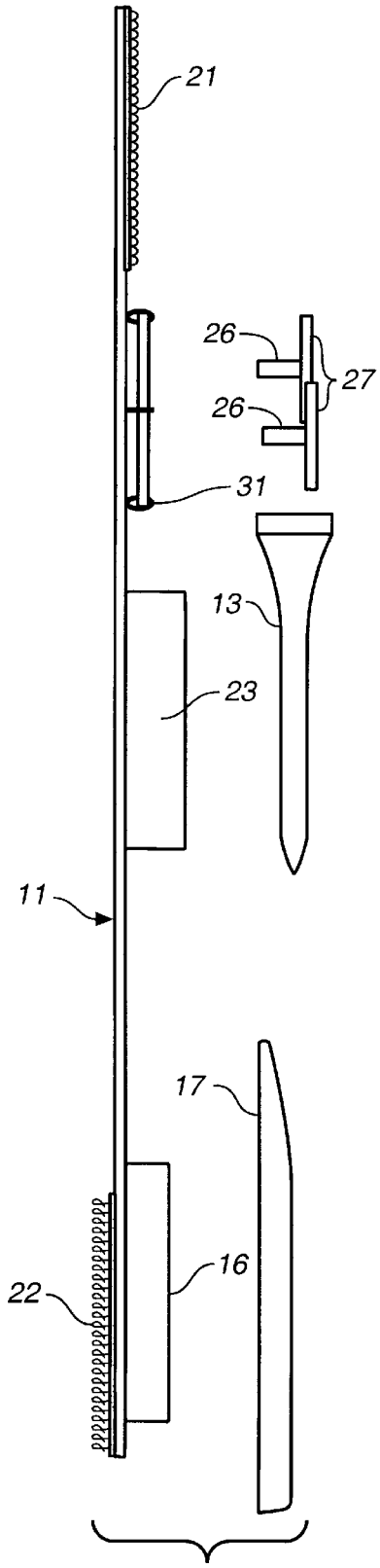
FIG. 6 is a side view of the wrist band in FIG. 5 also showing the accessories in side view.

As seen in the side views of FIGS. 4 and 6, ball markers 15 are formed with a shaft 26 that holds the marker in position on the ground and a disc-shaped marker end 27 that provides a visible indication of the ball position. Ball marker holder 14 includes a retaining member 28 formed to hold a plurality of ball markers at their shaft ends. In the illustrated embodiment retaining member 28 is provided by a plastic disc formed of interconnecting filaments 29 defining an array of openings or holes 30 between the filaments that are sized to receive and frictionally retain the shafts 26 of the ball markers. The ball markers are pushed into the retaining member 28 and the shaft ends of the markers find a nearby hole 30 and are held in the hole by friction. When needed, the markers may simply be pulled out of retaining member 28. The action of the retaining member in releasably holding the marker shafts is much like the action of a pin cushion in holding pins, and the markers may be thought of as being retained "pin-cushion style," except that here there is no need for a sharp end on the marker shaft to penetrate the retaining member. To achieve the pin-cushion style retention of markers it is not necessary that retaining member be circular in shape as illustrated in the figures. Square, rectangular or other array shapes may also be used. It is also not necessary that the array of retaining holes defined by retaining member 28 be formed by the openings between interconnecting filaments, but may for example, also be provided by an appropriately sized perforated sheet. The holes of the array need only have appropriate size and density in the array so that a marker will readily be received in a hole when inserted "pin-cushion style" and will be held there by friction. Those skilled in the art will be able to fashion a retaining member of a number of materials and the size and density of holes can readily be determined empirically for any given material. Thus, the retaining member is not intended to be limited to the particular plastic, disc-shaped retaining member illustrated in the figures.

In the disclosed embodiment retaining member 28 is sewn to carrier band 11 with several attachment links 31. Of course, sufficient clearance must be available behind retaining member 28 to receive marker shafts that penetrate through the retaining member. If a flexible stretch material is used for the carrier band directly behind the retaining member, then the retaining member may be sewn or otherwise attached directly to the carrier material and the natural give of the flexible stretchable material will provide the clearance. If a harder material having less give is located directly behind retaining member 28, then the retaining member may be spaced slightly from the backing material to provide the clearance.

Carrier band 11 may also include an auxiliary holder 16. As illustrated here, the auxiliary holder carries a divot tool 17, but the auxiliary holder may be formed to carry whatever additional accessories are desired. For example, auxiliary holder 16 may be formed to carry additional golf tees. In the illustrated embodiment the auxiliary holder is formed by a stretchable fabric material that is sewn in a direction along the edges of the carrier band to define an open-ended pocket for receiving divot tool 17. The stretchable material stretches in the direction across the carrier band to define a snug pocket. Where the auxiliary holder is formed to carry a divot tool, additional golf tees, or similarly elongate pieces that project beyond the edge of the holder, it is preferable that ball marker holder 14 be disposed between golf tee holder 12 and auxiliary holder 16 so that the projecting ends of the golf tees and elongate auxiliary pieces not interfere with one another. In general, to minimize interference between the projecting ends pieces that are being held and to provide unobstructed access to the pieces, it is desirable that the holders be positioned on the carrier band so that the golf tee holder will lie at one side of the wearer's wrist, the ball marker holder will lie at another side, for example, the top, of the wearer's wrist, and the auxiliary holder will lie at a third side of the wearer's wrist.

As illustrated here, golf tee holder 12 and auxiliary holder 16 are sewn permanently to carrier band 11. Alternatively, these holders may be sewn or otherwise attached to a hook and loop backing strip, and a cooperating hook and loop backing strip may be provided at the positions on the carrier strip for securing the holders to the carrier strip. In this way various holders may be applied interchangeably to the carrier strip.

Although the carrier band has been described herein as a "wrist band," it is understood that the band does not have to be worn on the wrist, but may also be attached to a golf bag, hooked to an article of clothing, or carried in any other manner convenient for the individual user. All such configurations of carrier band are nevertheless referred to herein simply as wrist bands.

The above descriptions and drawings disclose illustrative embodiments of the invention. Given the benefit of this disclosure, those skilled in the art will appreciate that various other modifications, alternate constructions, substitutions of materials and the like may also be employed to achieve the benefits of the invention and though not specifically disclosed herein may nevertheless fall with the scope of the invention as determined by the appended claims.

What is claimed is:

1. In an article to be worn by a user for carrying golf accessories, the article including a carrier band having a fastener for securing the carrier band around a user's wrist and a golf tee holder attached to the carrier band formed and arranged to define a plurality of tee pockets for receiving a plurality of golf tees, the improvement comprising:

a retaining member attached to said carrier band for receiving and holding a plurality a golf ball markers, said golf ball markers having a free shaft end and said retaining member being formed to frictionally hold said golf ball markers by said free shaft ends.

2. The apparatus of claim 1 wherein said retaining member is formed to define an array of openings sized to receive and frictionally retain said ball marker shaft ends.

3. The apparatus of claim 1, further comprising an auxiliary holder attached to said carrier band formed and arranged to define an auxiliary pocket for receiving a golf related accessory.

4. The apparatus of claim 3 wherein said retaining member is disposed on said carrier band between said golf tee holder and said auxiliary holder, whereby said golf tees may project from said tee pockets and said golf related accessory may extend from said auxiliary pocket without interfering with one another.

5. The apparatus of claim 4 wherein said golf tee holder, said retaining member, and said auxiliary holder are disposed on said carrier band such that when said carrier band is worn on the wrist of a user said golf tee holder is disposed at a first side of the user's wrist, said retaining member is disposed at a second side of the user's wrist, and said auxiliary holder is disposed at a third side of the user's wrist.

6. The apparatus of claim 3 wherein said golf tee holder and said auxiliary holder are removably attached to said carrier band whereby said holders may be interchangeably attached to said carrier band at the user's discretion.

* * * * *